US005443142A

United States Patent [19]

Glaser

[11] Patent Number: 5,443,142

[45] Date of Patent: Aug. 22, 1995

[54] ELEVATOR DOOR TAMPERING PROTECTION SYSTEM

[75] Inventor: Walter Glaser, Saddle River, N.J.

[73] Assignee: G.A.L. Manufacturing Corp., Bronx, N.Y.

[21] Appl. No.: 162,712

[22] Filed: Dec. 6, 1993

[51] Int. Cl.[6] ..... B66B 13/22

[52] U.S. Cl. ..... 187/316; 187/391

[58] Field of Search ..... 187/104, 103, 102, 120, 187/316, 280, 279, 391

[56] References Cited

U.S. PATENT DOCUMENTS

| | | | |
|---|---|---|---|
| 1,680,771 | 8/1928 | Davis | 187/103 |
| 1,876,438 | 9/1932 | Werner | 187/103 |
| 1,929,391 | 10/1933 | Liebenberg | 187/29 |
| 2,019,456 | 10/1935 | Liebenberg | 187/52 |
| 2,185,748 | 1/1940 | Kebelman | 187/104 |
| 2,432,293 | 12/1947 | Giovanni | 187/104 |
| 4,108,281 | 8/1978 | Glaser | 187/104 |
| 4,750,591 | 6/1988 | Coste et al. | 187/130 |
| 5,107,964 | 4/1992 | Coste et al. | 187/104 |

*Primary Examiner*—Steven L. Stephan
*Assistant Examiner*—Robert Nappi
*Attorney, Agent, or Firm*—Brooks Haidt Haffner & Delahunty

[57] ABSTRACT

An automatic elevator system having car movement controls, door controls, a door operating mechanism for automatically opening and closing at least the car door and first switch contacts operable when the car and hoistway doors are closed to permit the car to move from a floor in combination with further switch contacts which are operable in accordance with the positions of the doors and which prevent the car from moving from a floor when the first switch contacts are operated before the further switch contacts to prevent movement of the car from a floor when the first switch contacts have been operated or shunted by unauthorized persons or by a short circuit and other means to protect against failures of other circuits operated by the first switch means and further switch means.

14 Claims, 2 Drawing Sheets

ELEVATOR DOOR TAMPERING PROTECTION SYSTEM

FIELD OF THE INVENTION

This invention relates to circuits for preventing elevator car movement from a floor in the event that normal operation of conventional door switches and/or interlock switches used therewith has been modified by interference therewith or shorting thereof or malfunctions of the circuits used therewith.

BACKGROUND OF THE INVENTION

Automatic elevator car systems, i.e., systems in which the car door automatically opens when the car reaches a floor and close before the car leaves a floor, are well-known in the art. In such systems, the hoistway door may be automatically opened and closed or may be manually opened and closed. In such systems, there usually is a switch or switches operable when the hoistway door is closed and a switch or switches operable when the car door or gate is closed which permits the car hoisting apparatus to move the car to another floor when all switches have been operated. Also, such systems usually include locking circuits which prevent opening of the doors unless the car is substantially level with the floor at which the doors control entrance and egress from the car and include a safety edge on one or more of the doors to recycle the doors and prevent starting of a car from a floor when closing of a door is obstructed.

Such known systems operate satisfactorily when there is no deliberate interference therewith. However, juveniles, persons intending to commit robbery and others, find it exciting or convenient to interfere with the normal operation for mischievous or criminal reasons and learn how to disable a car, to prevent normal door operation or to leave open a hoistway door after the car has left the floor where the door is located.

For example, when the hoistway door is open, the switch or switches operable thereby are accessible to the knowledgeable. Although such opening of the door will, by reason of the conventional circuits, stop the associated car, the hoistway door switch, which is on the hoistway wall, may be disabled or by-passed intentionally, such as by a shunt, to permit the car to continue to operate or may be accidentally by-passed, such as by shorting thereof.

Similarly, the car door or gate switch or switches are accessible from the car doorway or the hoistway doorway, and if the switch or switches are disabled or by-passed, the car will move even if the door or doors of the car are not closed, creating a passenger hazard and permitting the car to be stopped and started by manipulation of the car door switch or switches.

Conventional elevator systems also may have either an automatic sliding or a manually operable, swinging hoistway door.

Many of such known systems are in use, and the main object of the invention is to permit the addition to such systems of relatively simple apparatus which will make it extremely difficult to tamper with normal operation of an elevator car including the malfunction of the circuits added thereto without causing the car to remain at the floor where the tampering or malfunction occurs and, preferably, causing the sounding of an alarm. However, the principles of the invention are also applicable to newly installed elevator systems.

It has heretofore been proposed for elevator systems having swinging hoistway doors that duplicate hoistway or floor door switches be added at the floors of a building which are inaccessible from the car or hoistway door and which are protected to prevent movement of a car when the normal floor door switches are tampered with or are accidentally by-passed. However, such duplicate switches must be installed in the hoistway with separate wiring and protect against only by-passing of the floor door operated switches. Also, such duplicate, or back-up, switches are operated at the same time as the normal switches and if similar switches are used in elevator systems having power operated, sliding, hoistway doors, the car would be stopped at a floor with the doors closed thereby preventing passenger egress without further action by a passenger or supervisory personnel.

In my prior art U.S. Pat. No. 4,108,281, I have disclosed a door tampering protection system which is satisfactory for preventing operation of an elevator car under the described tampering situations, but there are other situations, such as malfunctions of a portion or portions of the protection circuits, serviceman errors, etc., to which it is highly desirable that the protection circuit be responsive. Furthermore, it is desirable to simplify the circuit of said U.S. Pat. No. 4,108,281 insofar as the functions performed thereby are concerned.

For example, standard elevator circuits have the gate, or floor door, switch and the car door lock circuits connected in series, and because the gate switch closes first as the doors close, door lock tampering or shorted door contacts cannot be sensed until the gate switch closes.

The door movement between closing of the gate switch and the closing of the door contacts is $1\frac{1}{2}$ inches or less, and in such amount of movement, tampering must be detected and the door movement altered, e.g. reversed. It is possible, by manually forcing the door to close, to allow the car to run. Also, in the circuit of said U.S. Pat. No. 4,108,281, if there is an open circuit or coil failure, such failures are undetected and protection is lost.

In addition, while two switches responsive to gate and door conditions can be used in the present invention, as in the circuit of said U.S. Pat. No. 4,108,281, the circuit of the preferred embodiment of the present invention permits the elimination of one of the switches.

SUMMARY OF THE INVENTION

In the preferred embodiment of the invention for the latter elevator system, the doors are prevented from closing and are reopened if partly closed when the normal floor door switches or the normal car door switches are by-passed or tampered with or with circuit malfunctions.

In the preferred embodiment of the invention, circuit means comprising switch means, such as switch means comprising relays and contacts, are added to the prior art tampering responsive circuits, responsive to provide additional safety in the event that there are malfunctions of one or more of the components of the prior art tampering responsive circuits.

In the preferred embodiment of the invention for use when both the hoistway and car doors are of the sliding type, a switch is provided at the top of the elevator car where it is inaccessible except by gaining access to the top of the car, and such access to the top of the car can be gained substantially only by authorized personnel or those with special knowledge of such personnel. Such switch is operable by a cam driven by the car door operating mechanism on the top of the car and controls relays which interrupt the circuits for the car hoisting apparatus, which cause the doors to open and which, preferably, cause an alarm to sound whenever the hoistway door or the car door is not almost fully closed when the switches normally operated by such doors to indicate that the car should start have been operated or by-passed or circuits thereof have been activated before the door reaches the almost fully closed position thereof. In such almost fully closed positions, such normally operated switches are inaccessible from the floor or from inside the car. Preferably, also, the hoistway door or doors and the car doors are provided with mechanical interengaging devices so that, when a car is at a floor, the hoistway door at the floor cannot be opened without opening the car door and the car door cannot be closed without closing the hoistway door at the floor.

In the preferred embodiment of the invention for use when the hoistway door is a swinging door and the car door or doors are of the sliding type, two switches, one actuated by the hoistway door and located at an inaccessible position, such as above the door frame and enclosed, and the other at an inaccessible position on top of the car and operable by a cam driven by the car door operating mechanism, are used to control relays which interrupt circuits for the car hoisting apparatus, which cause the car doors to remain open or re-open and which, preferably, cause an alarm to sound whenever the switch normally operable by the hoistway door is operated or by-passed before the hoistway door reaches its almost fully closed position, whenever the switch normally operable by the car door is operated or by-passed before the car door is substantially fully closed, and whenever the door interlock switches are operated or by-passed before the car door is substantially fully closed or whenever the circuits fail indicating an operated or by-passed car door or hoistway door switch whether or not such switch has been operated or by-passed.

One advantage of the invention is that protection against tampering with the normal operation of the elevator system is provided with relatively simple changes in a conventional automatic elevator system.

Another advantage of the embodiment of the invention is that in elevator systems in which both the hoistway and car doors are of the sliding type, it is unnecessary to add equipment on the hoistway wall and the doors re-open and remain opened if the hoistway door or car door switches have been tampered with and until such tampering has been removed.

BRIEF DESCRIPTION OF THE DRAWINGS

Other objects and advantages of the invention will be apparent to those skilled in the art from the following description of the presently preferred embodiments thereof, which description should be considered in conjunction with the accompanying drawings in which.

DETAILED DESCRIPTION

As mentioned hereinbefore, the invention relates to modification of well-known types of automatic elevator car systems. Such systems and components thereof are, for example, illustrated in U.S. Pat. Nos. 1,680,771; 1,876,438; 1,929,391; 2,019,456; 2,185,748 and 2,432,293 and in various technical publications including service manuals published by various elevator manufacturers.

In general terms, such systems include the following:

(1) At least one elevator car mounted for vertical movement in a hoistway extending between a plurality of floors in a building, said car having a sliding door, either one, two or more parts.

(2) A hoistway or floor door at each of the floors to provide access to the car, the door usually being of one or more sliding parts or being a one-part, pivotally mounted, swinging door.

(3) Control means including hoisting apparatus for moving the car from one of the floors to another, stopping the car at a floor, causing opening and closing at least of the car door at a floor at which the car is stopped, such control means being responsive to manually operable push buttons in the car and at each floor, to various switches on the car and at the floors, etc.

(4) Motor driven door operating means at the top of the car for opening and closing the car door when the floor door is a swinging door and both the car door and the floor door when both doors are sliding doors.

(5) A plurality of switches on the car and at the floors which are connected to the control means and which, when all the doors are closed and locked, permit operation of the circuits in the control means which cause the car to move. Usually included in such plurality of switches are a switch at each floor controlled in accordance with the position of the car door and operated by the locking mechanisms which hold the doors closed until the locking mechanisms are automatically released when the car is at a floor.

(6) Safety devices for preventing closing of the doors when a passenger is entering or leaving a car, one example of such a device being a so-called "safety edge" which usually contains a switch operable by an obstruction in the car doorway to cause the doors to re-open or at least stop further closing movement.

Figure 1:
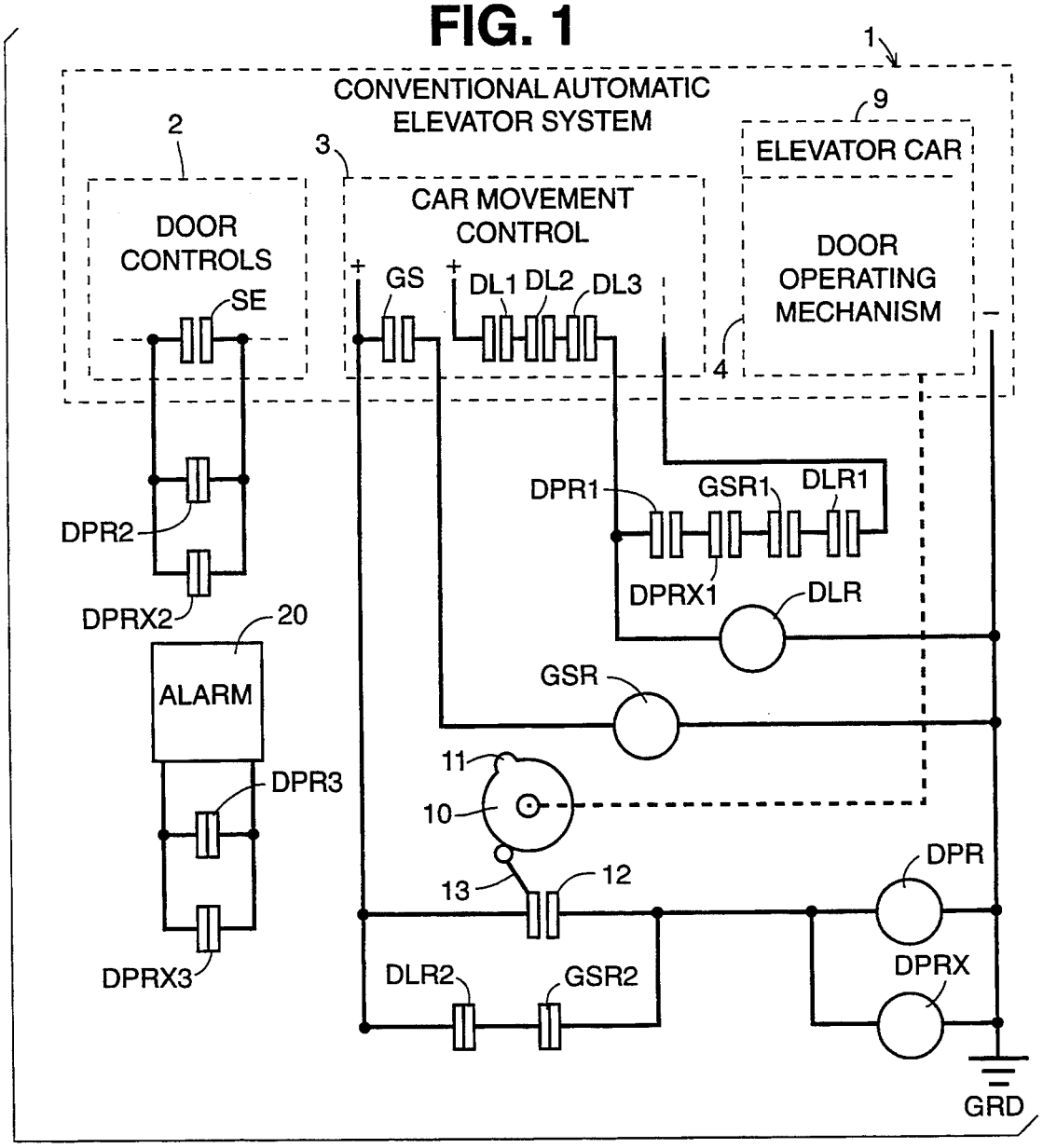
FIG. 1 is a schematic diagram of the preferred embodiment of the invention for use in connection with elevator systems having both an automatically driven car door and an automatically driven hoistway or floor door.
Figure 2:
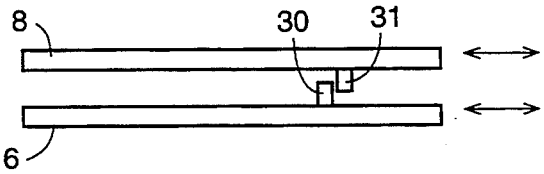
FIG. 2 is a diagrammatic, fragmentary, top view of a one-part, sliding hoistway door and a one-part, sliding car door.
Figure 3:
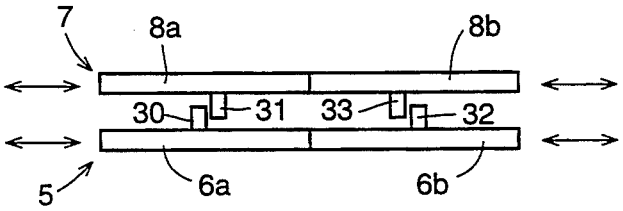
FIG. 3 is a diagrammatic, fragmentary, top view of a two-part sliding hoistway door and a two-part sliding car door.

FIG. 1 illustrates schematically such a conventional automatic elevator system with the rectangle 1, and the dashed line rectangles 2, 3 and 4 represent, respectively, the door controls, the car movement controls and the door operating mechanism usually associated with such an elevator system. For the purposes of illustrating the first embodiment of the invention, it will be assumed that the system 1 has a sliding car door 6 and a sliding hoistway or floor door 8 as illustrated in FIG. 2. However, it will be understood that the system may have a sliding car door 5 (FIG. 3) having two parts 6*a* and 6*b* and each hoistway or floor door 7 may have two parts 8*a* and 8*b* as illustrated in FIG. 3. It will also be assumed that there is a motor driven door operating mechanism at the top of the elevator car 9 which opens and closes both the car and the hoistway doors 6 and 8 under control of the door controls 2, and the door controls 2 include a safety edge switch with contacts SE which, when at least momentarily closed, normally cause the car and hoistway doors 6 and 8 to reopen and after reaching full open positions, again move toward their closed positions.

In the elevator system assumed for purposes of illustration, it will also be assumed that the elevator car travels between three floors, although there may be a greater or lesser number of floors and that there also are circuit closing means comprising switches at each floor providing at least a pair of contacts DL1, DL2 and DL3 which are closed when the locking mechanism for the doors, operable in conjunction with the door operating mechanism 4, locks the doors so as to prevent manual openings thereof. Thus, there are contacts DL1 at one floor, contacts DL2 at the second floor and contacts DL3 at the third floor which are open at a floor where the car is located when the doors are not closed and locked, but such contacts are closed when the doors are closed and locked. In addition, there is circuit closing means comprising a switch having a pair of contacts GS which are closed when the car door 6, also known as a "gate", approaches its fully closed position.

The contacts DL1, DL2 and DL3 and GS are normally connected in series, without the modification of the invention, so that when they are all closed, circuits on the car movement controls 3 are completed and the car 9 moves from a floor.

Such contacts GS normally are opened and closed by the car door but may be opened and closed by any means which corresponds in position with the position of the car door. In accordance with the invention, circuit closing means comprising one cam 10 is added to the door operating mechanism 4 so that the projection 11 thereof corresponds in position to the position of the car door 6 and operates the contact 12 of a switch 13. The cam 10 operates the contact 12, i.e., closes the contact 12 just before the contacts GS are closed and before the door locking contacts at the floor where the car is located, e.g. contacts DL1, DL2 or DL3, are closed.

Switch means comprising a relay GSR is connected in series with the contacts GS. Therefore, when the contacts GS are closed, the relay GSR is energized causing closing of its contacts GSR1 and opening of its contacts GSR2.

Switch means comprising a relay DLR is connected in series with contacts DL1, DL2, DL3. Therefore, when these contacts are closed, the relay DLR is energized causing closing of its contacts DLR1 and opening of its contacts DLR2.

Switch means comprising relays DPR and DPRX which are energized when relays GSR and DLR are deenergized and contacts DLR2 and GSR2 are closed. Relays DPR and DPRX are also energized when contacts 12 of switch 13 are closed regardless of the status of the GSR and DLR relays.

When relays DPR and DPRX are energized, contacts DPR1 and DPRX1 are closed and contacts DPR2, DPRX2, DPR3 and DPRX3 are opened.

The usual operation of the contacts DL1, DL2, DL3 and GS and the settings of the cam 10 in the preferred embodiments of the invention are such as to provide the following sequence:

| Contacts | Operation |
|---|---|
| DL1, DL2 and DL3 | Open except when hoistway door fully closed and locked, which occurs when car door within ⅜ in. of fully closed |
| GS | Open except when car door within 2 ins. of fully closed |
| 12 | Open except when car door within 2½ ins. of fully closed |

The examples of operations given hereinafter illustrate the operations with respect to one floor, but it is to be understood that the operations are the same at each floor at which the elevator car stops.

Normal Operation

Let it be assumed that the elevator system is operating normally and properly, i.e., the relays DLR, GSR, DPR and DPRX are operating properly, that the contacts DL1, DL2 and DL3 and GS have not been interconnected either by manual operation thereof or otherwise and that the car and hoistway door are open, the car 9 being stopped at the floor having contacts DL1. Contacts DL2 and DL3, at the second and third floors, will be closed because the hoistway doors at such latter floors are closed and locked. Relays DLR and GSR are deenergized with contact DLR2 and GSR2 closed and relays DPR and DPRX energized. The door controls 2 allow circuits causing the door operating mechanism 4 to move the doors 6 and 8 toward their closed positions, and as the car door 6 reaches a position within approximately 2½ inches of its fully closed position, the contacts 12 of switch 13 close keeping relays DPR and DPRX energized regardless of relays GSR and DLR.

As the car door 6 reaches the position within approximately 2 inches of its fully closed position, the contacts GS close energizing relay GSR, opening contacts GSR2 and closing contacts GSR1. As the car door 6 then reaches a position within approximately ⅜ inches from its fully closed position, the contacts DL1 close, energizing the DLR relay. Contacts DLR2 open. Contacts DLR1 close, completing the circuit for starting the car 9 by way of contacts DL1, DL2, DL3, DPR1, DPRX1, GSR1 and DLR1.

Car Door Contacts Interconnected or GSR Relay Failure in the Energized or Deenergized Position Let it be next assumed that the car 9 is stopped at the first floor with the car and hoistway doors open. Let it also be assumed that the car door contacts GS have either been manually operated or by-passed, or that the GSR relay is stuck in the energized position, e.g., by a shunt or short or relay failure and the car and hoistway doors commence to close. When the car door 6 and the hoistway door 8 have reached positions approximately 2½ inches from their fully closed positions, it is physically impossible to gain access to the gate or car door switch which includes the contacts GS. However, if the contacts GS are closed or by-passed prior to the time that the doors 6 and 8 have reached such position, and hence, prior to the time that the contacts 12 close, the relay GSR will be energized through the contacts GS, or the by-pass thereof or relay failure.

Energizing of the relay GSR or failure of the relay to deenergize (such as by mechanical bind or residual magnetism) prior to the closing of contacts 12, will open contacts GSR2 thereby deenergizing relays DPR and DPRX. Contacts DPR1 and DPRX1 will open thereby interrupting the car starting circuits of controls 3, and contacts DPR2 and DPRX2, which are in parallel with the safety edge switch contacts SE, will close causing the door to re-open and remain open until the contacts GS are opened or the by-pass thereof removed, or the failed GSR relay fixed.

In the preferred embodiment of the invention relays DPR and DPRX have contacts DPR3 and DPRX3 connected to a well-known type of alarm system 20 e.g., a bell or buzzer with an energizing source and when contacts DPR3 and DPRX3 close by way of the deenergized relays DPR and DPRX, the alarm will sound.

Should the GSR relay fail to energize, whether by normal operation of the GS switch or by manual operation or binding or open circuit thereof, the car is still prevented from running by virtue of the GSR1 contacts being opened in the circuit of the Car Movement Controls 3.

Door Locking Connects Interconnected of DLR Relay Failure in the Energized or Deenergized Position Let it next be assumed that the car 9 is stopped at the first floor with the car and hoistway doors open. Let it also be assumed that the door locking contacts DL1, DL2 and DL3 have either been manually operated or by-passed, or that the DLR relay is stuck in the energized position, e.g., by a shunt or short or relay failure and the car and hoistway doors commence to close. When the car door 6 and the hoistway door 8 have reached positions approximately 2½ inches from their fully closed positions, it is physically impossible to gain access to the gate or door lock switches which include the contacts DL1, DL2 and DL3. However, if the contact DL1, DL2 and DL3 are closed or by-passed prior to the time that the doors 6 and 8 have reached such position, and hence, prior to the time that the contacts 12 close, the relay DLR will be energized through the contacts DL1, DL2 and DL3, or the by-pass thereof or relay failure.

Energizing of the relay DLR or failure of the relay to deenergize (such as by mechanical binding or residual magnetism) prior to the closing of contacts 12, will open contacts DLR2 thereby deenergizing relays DPR and DPRX. Contacts DPR1 and DPRX1 will open thereby interrupting the car starting circuits of controls 3, and contacts DPR2 and DPRX2, which are in parallel with the safety edge switch contacts SE, will close causing the door to re-open and remain open until the contacts DL1, DL2 and DL3 are opened or the by-pass thereof removed, or the failed DLR relay fixed.

Should the DLR relay fail to energize whether by normal operation of the DL1, DL2 and DL3 switches or by manual operation or binding or open circuit thereof, the car is still prevented from running by virtue of the DLR1 contacts being opened in the circuit of the Car Movement Controls 3.

Accordingly, in the preferred embodiment of the invention, only one switch 13 is used to prevent car movement, to open or keep the doors open and to sound an alarm if either the door interlock switch contacts at a floor, e.g., DL1, DL2 or DL3 or car switch contacts GS are closed or shunted or further circuits indicate that these switches are closed or shunted (regardless if they are actually closed or shorted) before the doors reach positions which prevent practical access to these switches.

Since the relays DPR and DPRX have identical functions, namely, contacts DPR1 and DPRX1 in series and contacts DPR2 and DPRX2 in parallel and contacts DPR3 and DPRX3 in parallel, the failure of either relay to release in the intended manner will still allow the other to release when required and all the required functions will still be performed, namely, the car will not run with the contacts "1" of either relay opened, the door will open or remain opened by reason of contacts "2" of either relay, and the alarm can sound by reason of contacts "3" of either relay. In addition, if either relay fails to energize, the car will remain stopped with doors open and the alarm sounding until the failure has been corrected. Furthermore, it will be apparent to those skilled in the art that if either relay DPR or DPRX fail to operate together as intended, this failure can be detected and the car prevented from running until the failure is corrected.

Relays DPR and DPRX and their contacts are included for the added safety provided, but if the added safety feature is not desired, one or the other of DPR and DPRX and its associated contacts can be omitted.

The system as described in the preferred embodiment prevents the car from running with open circuits. Namely, open circuits in the GS contacts and GSR relay, open circuits in the DL1, DL2, DL3 contacts or the DLR relay, and in the DPR1, GSR1, DLR1 circuits preventing the car from running. Furthermore, openings in the circuits feeding the DPR and DPRX relays will either keep the DPR and DPRX relays deenergized, or if the open circuit is in the contacts 12, the DPR and DPRX relays will drop when the GS or DL1, DL2 and DL3 contacts make preventing the car from running until the open circuit is corrected. Since one side of the line is grounded, an accidental ground on the circuit side of the line will short out relays and prevent the car from running. A fuse in the positive side of the line would also blow, preventing further operation.

It will be apparent to those skilled in the art that if it is desired to omit protection against closing or shunting of the door interlock switch contacts or the contacts GS or the sounding of an alarm, the circuits, switches and contacts associated with such features may be omitted. Similarly, other types of door operation may be initiated by the controls of the invention, or if desired, the doors may be permitted to close without permitting departure of the car.

As a further aid in preventing closing of the car door 6 without simultaneous closing of the hoistway 8, the car door 6 may be provided with a projection 30 and the hoistway door 8 may be provided with a projection 31 engageable with the projection 30, as shown in FIG. 2, so that the car door 6 cannot be closed unless the hoistway door 8 also closes. Thus, assuming that both doors close in the direction to the right as viewed in FIG. 2, car door 6 cannot be closed unless the door 8 also closes, because of the projections 30 and 31. With such projections 30 and 31, the car 9 cannot start from the floor unless the door 8 is closed and the door 8 cannot be held open to permit access to switches and other apparatus on the car 9 when the door 6 closes.

Similarly, as shown in FIG. 3, the car door parts 6*a* and 6*b* and the hoistway door parts 8*a* and 8*b* may be provided with inter-engageable projections 30, 31, 32 and 33 which prevent closing of the door 5 without closing of the door 7. With such inter-engageable projections 30–33 the car 9 will not start from a floor unless the door 7 is closed.

Conventional Swinging Hoistway Door System and Modification

Figure 4:
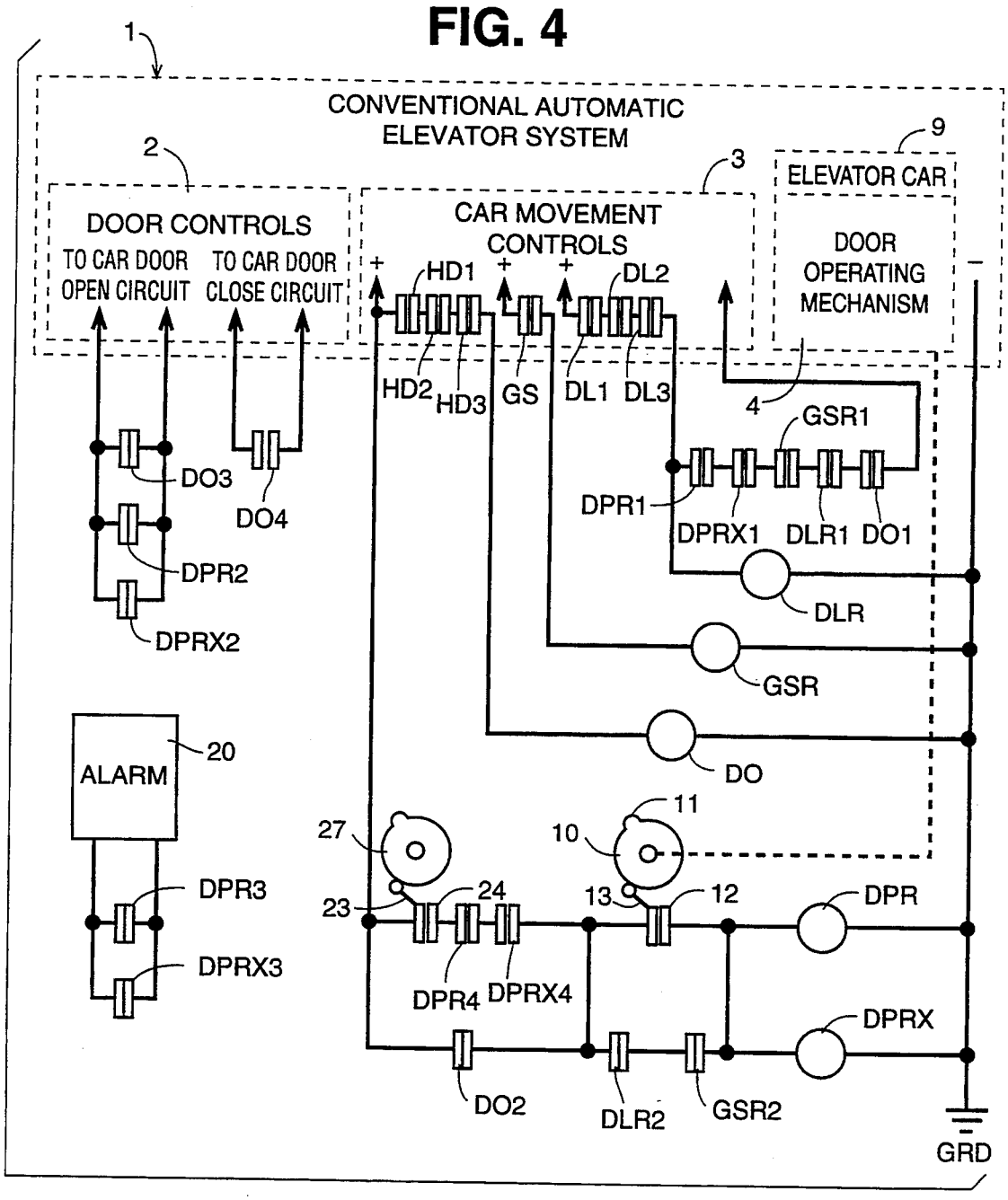
FIG. 4 is a schematic diagram of the preferred embodiment of the invention for use in connection with an elevator system having an automatically driven car door and a manually operable swinging hoistway door.

FIG. 4 illustrates a conventional automatic elevator system similar to the system shown in FIG. 1, except for the modifications thereof required to permit employment thereof in an elevator installation in which the hoistway or floor door is a swinging door and is manually operated rather than operated by the car door operating mechanism of the car 9. The car movement controls of the system shown in FIG. 4 differ from the car movement controls in the system shown in FIG. 1 mainly in the addition of the contacts HD1, HD2 and HD3, controlled by the hoistway doors, contacts HD1 being at floor 1, contacts HD2 being at floor 2 and contacts HD3 being at floor 3. These contacts close when the hoistway door is fully closed and indicate that the car door can then close when a call has been initiated. Opening of a hoistway door will open the contacts of that floor, and circuits are established to keep the car doors opened. The operation of the GS switch and contacts are as previously described under the conventional sliding door system and since the door locking contacts DL1, DL2 and DL3 are operated by a cam connected to the car door operating mechanism as the car door approaches the fully closed position. The contacts also make at the same time as previously described with respect to the conventional sliding door.

In normal operation of the system shown in FIG. 4 without the modifications of the invention, the contacts HD1–HD3, GS and DL1–DL3 are connected in series so that it is necessary that all of such contacts be closed before the car 9 can move from a floor. Thus, if the hoistway door, the car door and the door interlocks function in their intended manner, the elevator car 9 is permitted to move from a floor.

Figure 5:
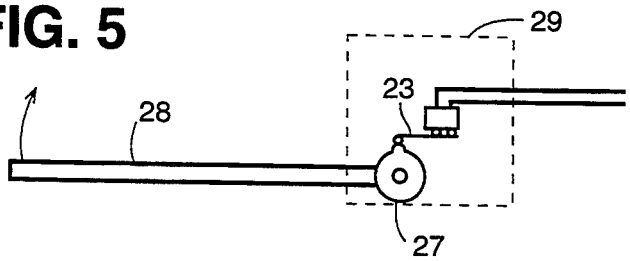
FIG. 5 is a diagrammatic, fragmentary, top view of a swinging hoistway door in conjunction with the switch operated thereby and shown in FIG. 4.

In the preferred embodiment of the system shown in FIG. 4, the same system is used as in FIG. 1 for the protection of the GS and DL1, DL2 and DL3 contacts. The conventional DO relay has its usual contacts DO3 and DO4 for controlling the opening and closing of the car door and since the HD1, HD2 and HD3 are not now connected in their normal series arrangement with contacts GS and DL1, DL2 and DL3, an additional contact DO1 of the relay DO is added in the new series circuit for the elevator running controls. For protection of the HD1, HD2 and HD3 contacts, another modification of the conventional elevator system also includes the addition at each floor of a switch 23 having contacts 24, operable by a cam 27 secured to the swinging hoistway door 28 (FIG. 5) so as to rotate as the hoistway door 28 opens and closes. The switch 23 preferably is mounted in the hoistway above the hoistway door, it being understood that there is one such switch 23 for each such hoistway door 28, and preferably, the switch 23 and the cam 27 are enclosed in a tamper-proof housing illustrated by the dotted rectangle 29. The contacts of each switch 23 are connected in series with each other, and all contacts are closed when all hoistway doors are closed.

Each of the contacts 24 control the self-holding circuits of Relays DPR and DPRX with additional contacts DPR4 and DPRX4 added.

The usual operation of the contacts DL1–DL3, GS and HD1–HD3 and the settings of the cam 10 and 27 in the preferred embodiment of the invention are such to provide the following sequence:

| Contacts | Operation |
|---|---|
| HD1–HD3 | Open except when hoistway door substantially closed |
| GS | Open except when car door within 2 in. of fully closed |
| DL1–DL3 | Open except when car door within ½ in. of fully closed; indicate locking of hoistway door |
| 12 | Open except when car door within 2½ ins. of fully closed |
| 24 | Open except when hoistway door within ¾ in. of fully closed |

Normal Operation

Let it be assumed that the elevator system is operating normally and properly, i.e., relays DO, DLR, GSR, DPR and DPRX are operating properly and the contacts HD1, HD2, HD3, DL1, DL2, DL3 and GS have not been interconnected either by manual operation thereof or otherwise, that the car and hoistway doors are open and that the car 9 is stopped at the first floor. As the passenger enters the car and the hoistway door 28 is closed, the contacts 24 close and then the contacts HD1 close. The prior closing of contacts 24 with contacts DPR4 and DPRX4 prevent the deenergization of the DPR and DPRX relays when the further contact HD1 closes energizing the DO relay, opening the contacts DO2 and DO3, while closing contacts DO1 and DO4. The door open circuit is opened by contacts DO3 and closing of contacts DO4 readies the car door closing circuit. Thereafter, the pressing of a car button or the existence of a floor call will cause the door controls to commence closing of the car door 6. The further operation of contacts GS, DL1, DL2, DL3 and relays GSR, DLR, DPR an DPRX are as described under normal operation for sliding doors. After the doors are fully closed, contacts DL1, DL2, DL3, DPR1, DPRX1, GSR1, DLR1 and DO1 are closed, completing the circuits in the car movement controls 3, which causes the car 9 to start from the floor.

Hoistway Door Contacts Interconnected or Failure of do Relay to Deenergize or to Energize Again, let it be assumed that car 9 is stopped at the first floor with the car and hoistway doors open. When the hoistway door 28 reaches a point ¾ inches from its fully closed position, it is not possible to gain access to the contacts HD1. If, however, the contacts HD1 are interconnected or the relay DO is stuck in the energized position, i.e., by a shunt or short or relay failure, the DO relay is then energized prior to the closing of switch 23, and contacts 24 and contacts DO2 will therefore deenergize relays DPR and DPRX, causing contacts DPR1 and DPRX1 to open preventing completion of the car movement control circuits. Contacts DPR2 and DPRX2 will close completing circuits to keep the door open controls signalled. Contacts DPR3 and DPRX3 can operate the alarm, and contacts DPR4 and DPRX4 prevent energization of these relays even if the hoistway door is then closed. Removal of the interconnection or correction of a relay malfunction would then allow normal operation.

If the DO relay fails to energize normally by reason of an open circuit or failed relay, contacts DO1 prevent the car from running.

In the case of a swinging door illustrated in FIG. 4, the interconnection of the car door contacts GS or the hoistway door contacts DL1, DL2 and DL3 or the failures of the circuits associated with them will operate as previously described under the sliding door description.

It will be apparent to those skilled in the art that if it is desired to omit any one of the protective features, such feature may be omitted by omitting the switches and contacts associated with the omitted feature. Similarly, other types of door operation may be initiated by the controls of the invention.

It will be apparent to those skilled in the art that in lieu of switch 13, additional switches can be used for door interlock contacts detection or car door contacts detection or a timing function or timing functions can be used starting when the door starts to close or is closing, and ending prior to the car door contacts and/or the floor door contacts normally make. If the car door or floor door contacts make prior to the end of this timing function or timing functions, a malfunction is indicated and the car can be prevented from running and the doors held open.

Also, it will be apparent to those skilled in the art, that electronic means, e.g. solid state devices, can be used in place of a mechanical relay or relays described and that further electronic means can be used for the checking of proper operation of the replacement electronic means.

Although preferred embodiments of the present invention have been illustrated and described, it will be apparent to those skilled in the art that various modifications may be made without departing from the principles of the invention.

I claim:

1. In an automatic elevator system having an elevator car with a car door, means mounting said car in a hoistway extending between a plurality of floors in a building, a floor door at each of said floors for providing access to said car, control means including hoistway apparatus for moving said car from one of said floors to another and stopping said car at a floor, door operating means for automatically opening and closing at least said car door when the car is at a floor, a first switch means including first circuit closing means and second circuit closing means normally operable in accordance with the positions of said car door for controlling said control means and permitting said control means to move said car from said floor to another floor when said car door and each said floor door is closed, and a second switch means connected in circuit with said first switch means and operable in accordance with the position of at least one of said car door and said floor door for normally preventing movement of said car when there has been tampering with said first switch means which causes abnormal operation of said first switch means and movement of said car without closing of both said car door and each said floor door, wherein the improvement comprises: a safety circuit means electrically connected to and separating said second circuit closing means and said control means, said safety circuit means being electrically responsive to said second switch means, said first circuit closing means and said second circuit closing means, for detecting failure of said first switch means, said second switch means and said safety circuit means to operate normally due to one of shorting, grounding, open circuits and failure of any component of one of said first and second switch means and said safety circuit means to operate normally and for the prevention of movement of said car when such failure is detected.

2. An elevator system as set forth in claim 1 wherein said second switch means is operable in accordance with the position of said car door.

3. An elevator system as set forth in claim 1 wherein said second switch means is operable in accordance with the position of said floor door.

4. An elevator system as set forth in claim 1 wherein said second switch means is operable in accordance with both said car door and said floor door.

5. An elevator system as set forth in claim 1 wherein said door operating means comprises third switch means for preventing closing of said car door and wherein said safety means comprises fourth switch means connected to said third switch means for preventing closing of said car door when movement of said car is prevented.

6. An elevator system as set forth in claim 1 wherein said first circuit closing means is operable to its closed state when said car door approaches, but is spaced from, the closed position of said car door and said second circuit closing means is operable to its closed state when said car door is substantially closed and said first circuit closing means has been operated to its closed state;

and wherein said second switch means comprises:

third circuit closing means operable to its closed state in accordance with the position of said car door and prior to the operation of said first circuit closing means to its closed state; and third switch means connected with said first circuit closing means and preventing movement of said car until said first circuit closing means is in its closed state;

and wherein said safety circuit means comprises:

fourth switch means connected with said second circuit closing means for preventing movement of said car until said second circuit closing means is in its closed state;

fifth switch means connected with said second circuit closing means for preventing movement of said car until said third circuit closing means is in its closed state; and said third circuit closing means, said third switch means and said fourth switch means being connected to said fifth switch means for maintaining said fifth switch means in its closed state only if one of said third circuit closing means, on the one hand, and both of said third and fourth switch means, on the other hand, is in its closed state.

7. An elevator system as set forth in claim 6 further comprising sixth switch means connected with said second circuit closing means for preventing movement of said car until said third circuit closing means is in its closed state, said sixth switch means being connected to said third circuit closing means, said third switch means and said fourth switch means and being operable in the same manner as said fifth switch means.

8. An elevator system as set forth in claim 7 wherein said door operating means comprises seventh switch means for preventing closing of said car door and wherein at least one of said fifth and sixth switch means is connected to said seventh switch means for preventing closing of said car door when movement of said car is prevented.

9. An elevator system as set forth in claim 6 further comprising alarm means and wherein said fifth switch means is connected to said alarm means for operating said alarm means when said fifth switch means prevents movement of said car.

10. An elevator system as set forth in claim 6 wherein said car door is a sliding door and said floor door is a swinging door, wherein said first switch means comprises fourth circuit closing means operable in accordance with the position of said floor door and wherein said safety circuit means includes fifth circuit closing means operable to its closed state when said floor door is substantially closed, said fifth circuit closing means being connected with said fifth switch means for preventing movement of said car until said floor door is substantially closed.

11. An elevator system as set forth in claim 10 wherein said fourth switch means is operable to its closed state as said floor door approaches, but is spaced from the closed position of said floor door and after said third circuit closing means has been operated by said car door to its closed state.

12. An elevator system as set forth in claim 11 wherein said safety circuit means comprises sixth switch means connected to said fourth circuit closing means and to said second circuit closing means for preventing movement of said car until said fourth circuit closing means is in its closed state.

13. An elevator system as set forth in claim 1 wherein said first circuit closing means is operable to its closed state when said car door approaches, but is spaced from, the closed position of said car door and said second circuit closing means is operable to its closed state when said car door is substantially closed and after said first circuit closing means has been operated to its closing state;

and wherein said second switch means comprises:

third circuit closing means operable to its closed state in accordance with the position of said car door and prior to the operation of said first circuit closing means to its closed state; and third switch means connected with said first circuit closing means and preventing movement of said car until said first circuit closing means is in its closed state;

and wherein said safety circuit means comprises:

fourth switch means connected with said second circuit closing means for preventing movement of said car until said third circuit means is in its closed state.

14. An elevator system as set forth in claim 13 further comprising fifth switch means connected with said second circuit closing means for preventing movement of said car until said third circuit closing means is in its closed state.

* * * * *

UNITED STATES PATENT AND TRADEMARK OFFICE

CERTIFICATE OF CORRECTION

PATENT NO. : 5,443,142

DATED : August 22, 1995

INVENTOR(S) : Walter Glaser

It is certified that error appears in the above-indentified patent and that said Letters Patent is hereby corrected as shown below:

Title page, item [57], col. 2,

In the Abstract, line 4, before "first" insert --having--;

line 13, change "and other means to protect against failures of other circuits operated by the first switch means and further switch means" to --. The first switch contacts include first contacts which close when the car door is closed and second contacts, electrically separated from the first contacts, which also close when the doors at the various floors are closed. A safety circuit including relays and contacts is connected to the first contacts and the second contacts, to the further switch contacts and to the car movement controls so that when the first contacts, the second contacts, the further switch contacts or the safety circuit fail to operate normally, such as by shorting, grounding, open circuits or failure, the car is prevented from moving from a floor.--;

Col. 12, line 26, after "safety" insert --circuit--.

Signed and Sealed this

Twelfth Day of March, 1996

Bruce Lehman

*Attest:*

BRUCE LEHMAN

*Attesting Officer*

*Commissioner of Patents and Trademarks*